US006109416A

United States Patent [19]

Nickerson

[11] Patent Number: 6,109,416

[45] Date of Patent: Aug. 29, 2000

[54] METHOD OF OPERATING A BILL AND COIN CHANGER

[76] Inventor: James L. Nickerson, 6705 Glenview Rd., Mayfield Village, Ohio 44143

[21] Appl. No.: 09/216,102

[22] Filed: Dec. 19, 1998

[51] Int. Cl.[7] ..... G07F 7/04

[52] U.S. Cl. ..... 194/206

[58] Field of Search ..... 194/206, 207

[56] References Cited

U.S. PATENT DOCUMENTS 5,310,035 5/1994 Dobransky, Jr. et al. ..... 194/206
5,544,728 8/1996 Dabrowski ..... 194/206

OTHER PUBLICATIONS

Advertisement—Mars Bill Acceptor Series 2000—Mars Electronics International, Oct. 1998.
Rowe BC–11 bill and coin changer—Field Service Manual and Parts Catalog—pp. 1–7 and 92–124, Feb. 1981.

*Primary Examiner*—Robert P. Olszewski
*Assistant Examiner*—Bryan Jaketic

[57] ABSTRACT

Method of operating a bill and coin changer wherein an existing bill validator from an existing bill acceptor and validator is replaced with a new bill validator which is operable to recognize both new style and old style United States currency. The bill validator is connected directly to the test vend inputs of an existing microprocessor control and a microprocessor control is conditioned so that when the new bill validator accepts and validates currency an output is provided from the bill validator to a test vend input of the microprocessor control which has a value which corresponds to the value of the currency validated in the bill validator, and wherein the microprocessor control, in response to the test vend input from the bill validator, dispenses a predetermined amount of change which is controlled by the value of the validated currency.

8 Claims, 1 Drawing Sheet

METHOD OF OPERATING A BILL AND COIN CHANGER

DESCRIPTION—TECHNICAL FIELD

The present invention relates to a method of operating a bill and coin changer and more particularly to a method of operating a bill and coin changer which includes a bill validator mechanism, a change dispensing mechanism and a microprocessor control and more particularly to a method of operating a bill and coin changer wherein the existing bill validator is replaced by a new bill validator which is operable to sense and validate currency and effect dispensing of the correct amount of change by the change dispensing mechanism by actuating the test vend inputs to the microprocessor control.

BACKGROUND OF THE INVENTION

Bill and coin changers are well known. The known bill and coin changers include a bill validator mechanism which is operable to sense and validate currency, a change dispensing mechanism for storing, counting and dispensing a predetermined number of coins or tokens in response to the receipt and validation of a bill by the bill validator. Typically, a microprocessor control interconnects the change dispensing mechanism and the bill validator. A well-known example of a bill and coin changer is the bill and coin changer Model BC-11 manufactured by Rowe International, Inc. whose operation is more fully described in the Field and Service Manual and Price Catalog for the BC-11 bill and coin changer dated February, 1981, which is incorporated by reference herein. The bill validator in the known Rowe Model BC-11 bill and coin changers are not operable to validate new five dollar bills which are scheduled to be released in the United States in the near future. Accordingly, it is desirable to be able to replace the bill validator in an existing Rowe Model BC-11 bill and coin changer with a new bill validator which is operable to validate new five dollar bills in the United States.

The present invention overcomes the disadvantages associated with the prior art Model BC-11 bill and coin changers by removing the bill validator in the bill and coin changer and replacing it with a Series 2000 bill changer manufactured by Mars Electronics International. The new Series 2000 bill validator will be operable to sense and validate new and old five dollar bills, two dollar bills and one dollar bills (in addition to other bills), and establish an output signal which is indicative of the validity of the bill validated and the denomination thereof.

SUMMARY OF THE INVENTION

The present invention provides a new and improved method of operating a bill and coin changer having a new bill validator installed therein and having an existing change dispensing mechanism and an existing microprocessor control for receiving signals from the bill validator and operating the dispensing mechanism in response to the signals, the bill validator being operable to accept and validate paper currency and generate an output signal representative of the validity and value of the validated currency, the microprocessor control includes a plurality of test vend inputs, each of which correspond to a value of currency to be validated and a plurality of coin detector inputs each of which is operable to receive signals indicative of receipt of a coin of a predetermined value into an escrow bucket including the steps of: (1) sensing currency to be validated by the new bill validator; (2) validating the currency and determining its value in the new bill validator; (3) establishing an output signal from the bill validator indicative of the value and validity of the validated currency; (4) directing said output signal to a test vend input of the microprocessor control which corresponds to the value of the validated currency; and (5) operating the change dispensing mechanism under the control of the microprocessor control, in response to receipt of the signal to the test vend input, to cause the change dispensing mechanism to empty one of the escrow buckets which has coins of a value therein which correspond to the value of the currency which has been validated.

Figure 1:
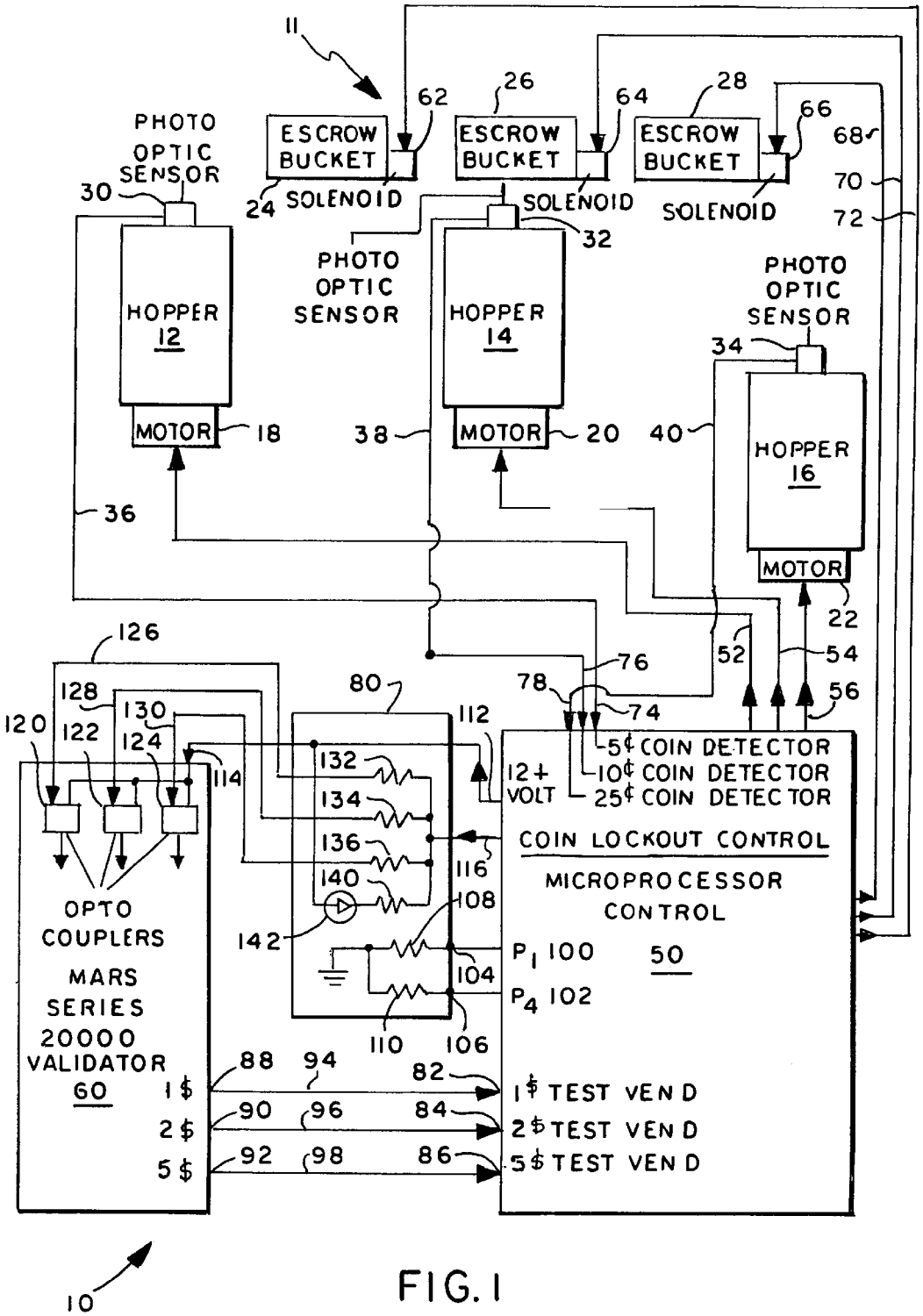
FIG. 1 is a schematic illustration of a Rowe Model BC-11 bill and coin changer having the bill validator replaced with a new Mars Series 2000 bill acceptor and interconnecting the output of the new bill validator to the test vend inputs of the microprocessor control of the BC-11 bill and coin changer.

DESCRIPTION OF THE PREFERRED EMBODIMENT.

The bill and coin changer 10 includes a bill validator 60 for examining and validating a bill, i.e., legal currency such as a one dollar, two dollar or five dollar bill , a change dispensing mechanism 11 for storing, counting and dispensing a predetermined number of coins in response to the receipt and validation of a particular bill and a microprocessor control 50 which controls operation of the change dispensing mechanism 11 in response to signals from the bill validator 60.

Inserting a bill into the bill validator 60 causes the bill to be examined to determine whether the bill is valid. If the bill is valid, a vend signal indicating the validity of the bill and the denomination thereof is directed from the validator 60 to the microprocessor control 50. If for example, the bill is a valid one dollar bill, the microprocessor control 50 will cause the change dispensing mechanism 11 to dispense one dollars' worth of change to a dispensing station, not illustrated. The exact coins to be dispensed can be programmed into the microprocessor control 50 in a well-known manner. For example, the change dispensing mechanism 11 could dispense four quarters or three quarters, two dimes and one nickel, or any other programmed combination of coins which equals one dollar.

The general operation of a bill and coin changer 10 is well known and the particular bill and coin changer 10 described herein is a bill and coin changer Model BC-11 manufactured by Rowe International, Inc. Rowe International, Inc. also sells Models BC-12, 20 and 35 and other bill and coin changers which are similar to the Model BC-11 and which could also be operated by the method disclosed herein.

The bill and coin changer 10 includes a plurality of hoppers 12, 14 and 16 which hold coins of the same or different denominations therein, for example, nickels, dimes and quarters, respectively. A drive motor 18, 20 and 22 is associated with each of the hoppers 12, 14 and 16, respectively. Escrow buckets, 24, 26, and 28 are associated with the hoppers 12, 14 and 16 and each escrow bucket is adapted to have a different amount of coins stored therein for dispensing. For example, in the preferred embodiment the escrow bucket 24 is adapted to have one dollars' worth of coins disposed therein, the escrow bucket 26 is adapted to have two dollars' worth of coins disposed therein and the escrow bucket 28 is adapted to have five dollars' worth of coins disposed therein. In the preferred embodiment, coins in each of the escrow buckets 24, 26 and 28 will be a predetermined number of nickels, dimes and quarters which have been transferred from the hoppers 12, 14 and 16. It should be appreciated that the coin changer could accept other bills, i.e., twenty or one hundred dollar bills or even foreign currency such as Canadian dollars and the escrow buckets can have other amounts and types of coins or even tokens therein. For example, the bill and coin changer 10 could be programmed to dispense nine dollars worth of coins for a ten dollar bill.

When it is desired to fill an escrow bucket, the motors, 18, 20 and 22 associated with the hoppers 12, 14 and 16, respectively, are energized to energize a coin transport mechanism (not illustrated) associated with each hopper which moves coins from the associated hopper 12, 14 and 16 to the escrow buckets 24, 26 and 28. A coin counting photocell 30, 32 and 34 is associated with each of the hoppers 12, 14 and 16 to count the number of coins transported from each of the hoppers to a particular escrow bucket to insure that the escrow bucket is filled with the proper amount of coins. Each of the photocells 30, 32 and 34 directs a signal over lines 36, 38 and 40, respectively, to a microprocessor control 50.

The microprocessor control 50 directs all of the operations of the bill and coin changer 10 including both the acceptance of validation signals from the paper currency validator 60 and the control of the change dispensing functions. The microprocessor control 50 is equivalent to the Control Computer Assembly part number 6-50428-01 manufactured by Rowe International, Inc. and includes a plurality of inputs and outputs to be described hereinafter which will have specified signals thereon when the bill and coin changer is operating properly to validate currency and dispense the proper amount of coins in response to the receipt of validated currency. The microprocessor control 50 includes outputs 52, 54 and 56 which are connected to drive motors 18, 20 and 22, respectively. Energization of outputs 52, 54 and 56 affects energization of drive motors 18, 20 and 22 and their associated coin transport mechanisms to transport coins from their associated hopper to one of the escrow buckets 24, 26 and 28.

A vend solenoid 62, 64 and 66 is associated with each of the escrow buckets 24, 26 and 28, respectively. Energization of a vend solenoid 62, 64 or 66 empties its associated escrow bucket and dispenses any coins stored therein to a coin dispensing station, not illustrated. The microprocessor control 50 includes outputs 68, 70 and 72 which are connected to the vend solenoids 62, 64 and 66, respectively. When the microprocessor control 50 establishes a signal on one of the vend solenoid lines 68, 70 and 72, one of the vend solenoids 62, 64 and 66 will be energized to dispense coins stored in its associated escrow bucket 24, 26 or 28.

Each of the photocells 30, 32 and 34 is connected via lines 36, 38 and 40, respectively, to the coin detecting inputs 74, 76 and 78 of the microprocessor control 50. In the preferred embodiment, the coin detecting input 74 receives signals from photocell 30 detecting the number of nickels transferred from hopper 12, the input 76 receives signals from photocell 32 detecting the number of dimes transferred from hopper 14 and the input 78 receives signals from photocell 34 which detects the number of quarters transferred from the hopper 16 to one of the escrow buckets. The coin detector inputs allow the microprocessor control 50 to count coins deposited into each of the escrow buckets, 24, 26 and 28 to insure that each escrow bucket is filled with the correct number and denomination of coins. The operation of the bill and coin changer 10 as described hereinabove, including the hoppers 12, 14 and 16, drive motors 18, 20 and 22, transport mechanisms, escrow buckets 24, 26 and 28, photocells 30, 32 and 34, vend solenoids 62, 64 and 66, and microprocessor control 50 is well-known and is incorporated in bill and coin changers manufactured by Rowe International, Inc. which are described in Rowe BC-11 bill and coin changer, Field Service Manual and Parts Catalog, Sixth Edition, February, 1981, Part No. 2-51694-01 which is incorporated by reference herein.

The bill and coin changer 10 includes: (a) the microprocessor control 50; (b) a coin dispensing mechanism 11, which includes: (1) hoppers 12, 14, 16; (2) escrow buckets 24, 26, 28; (3) motors 18, 20, 22 and associated transport mechanisms; and (4)solenoids 62, 64, 66 for emptying escrow buckets 24, 26, or 28 to dispense a predetermined amount of coins; and (c) a bill acceptor and validator mechanism 60. The bill acceptor 60 is adapted to receive paper currency therein and determine whether the paper currency is valid, i.e. non-counterfeit, and determine the denomination of the currency.

In the Rowe Model BC-11 Bill and Coin Changer and certain other Rowe bill and coin changers, the bill validator 60, is operable to validate and distinguish between old one dollar, and five dollar bills. The validator 60 includes a sensor head, not illustrated, a transport mechanism (not illustrated) for moving the bills past the sensor head, and a bill stacker (not illustrated) into which validated bills are stacked. Inserting a bill into the transport mechanism starts a motor which moves the bill along an acceptor track past the bill head where the bill is examined both optically and magnetically to determine if the bill is valid. If the bill is valid, a vend signal is directed to the vend solenoids and the bill drops into a bill stacker where it is stacked and stored. After the validator 60 scans the bill, the validator establishes output signals which are directed to the microprocessor control 50 which determines if the bill is valid and the denomination of the validated bill and causes the coin dispensing mechanism 11 to dispense the correct amount of change which corresponds to the denomination of the bill which has just been validated. The operation of the acceptor and validator mechanism is well known and is utilized in bill and coin changers such as in the BC-11 Bill changer Assembly Part Number 6-50511-01 manufactured by Rowe International, Inc. The operation of the coin dispensing mechanism 11, validator 60 and microprocessor control 50, as described hereinabove, is well-known in the art and is indicative of the operation of the Rowe Model BC-11 bill and coin changer.

With the release of new paper currency in the United States, it is desirable to have a bill validator 60 which can sense both new currency and old currency. The validators 60 in many existing bill changers, including the Rowe Model BC-11, utilize older technology which is expensive to maintain and repair. In the preferred embodiment of the present invention, the original Rowe validator 60 is removed and replaced with a bill validator manufactured by Mars Electronics International and known as the Mars Series 2000 Bill Acceptor. The operation of the Mars Series 2000 Bill Acceptor is well known and is disclosed in the Mars Bill Acceptor Series 2000 Technical Manual published in 1996 by Mars Electronic International which is incorporated herein by reference. The Mars Series 2000 Bill Acceptor includes a bill sensor for optically sensing the currency, a transport mechanism for moving the currency past the bill sensor and a bill stacker for stacking and storing validated currency. The new bill validator will be able to sense and distinguish between both new and old five dollar bills in addition to being able to sense and validate other denominations of U.S. and other currencies. It is desirable to be able to replace an existing Rowe bill validator with a new Mars bill validator. However, the outputs from the new Mars bill validators do not match the outputs from the older bill validators and the new bill validators cannot be directly plugged into the existing microprocessor control 50 without extensive conversion of the microprocessor control 50.

In the present invention, a Rowe Model BC-11 bill and coin changer manufactured by Rowe International, Inc., has the existing bill validator mechanism 60 removed and replaced with a new bill validator and, more particularly, with a Series 2000 Mars bill acceptor manufactured by Mars Electronics, International. The new bill validator is operable to optically scan the bill and determine if the bill is valid and the denomination of the validated bill. The bill validator is operable to send a signal to the microprocessor control 50 indicating the validity and denomination of the bill validated. This is in contrast to the Rowe bill validator which would scan the bill and send signals to the microprocessor control 50 which would analyze the signals to determine if a scanned bill was valid and, if valid, its denomination. Thus, when the Rowe bill validator is replaced by a new Mars Series 2000 bill validator, the portion of the microprocessor control 50 which analyzes the signals from the bill head is no longer used as this process is now done in the new bill validator 60.

A conversion board 80 is utilized, in part, to connect the microprocessor control 50 to the Mars Series 2000 bill changer 60, and the use of the conversion board 80 allows the vend outputs of the Mars bill validator to be connected to and operate upon command test vend inputs 82, 84 and 86 of the Rowe microprocessor control 50. The new Mars Series 2000 bill validator includes one dollar, two dollar and five dollar outputs 88, 90 and 92, respectively, which are connected to the test inputs 82, 84 and 86 of the microprocessor 50 via conductors 94, 96 and 98, respectively. When the bill validator senses the presence of a valid one dollar bill, a signal will be generated at the output 88 of the bill validator 60 which will be directed along line 94 to the one dollar test vend input 82 of the microprocessor control 50. The microprocessor control 50, upon receiving an input at 82, is designed to energize the vend solenoid 62 to vend one dollars' worth of coins from the one dollar escrow bucket 24. When the bill validator receives and validates a valid two dollar bill in the bill validator 60, a signal will be established on the output 90 of the bill validator 60 and directed along line 96 to the two dollar test vend input 84 of the microprocessor control 50. When an input is received at the two dollar test vend input 84, the microprocessor control 50 energizes vend solenoid 64 to dump coins from the two dollar escrow bucket 26 to the dispensing station, not illustrated. When a valid five dollar bill is validated by the bill validator, a signal will be established at the output 92 and directed along line 98 to the five dollar test vend input 86 of the microprocessor control 50. When the microprocessor control 50 receives a signal at the input 86, the microprocessor control 50 will energize the vend solenoid 66 to dump coins from the five dollar escrow bucket 28.

The Rowe microprocessor control 50 includes inputs 100 and 102 which are designed to be inputs from photocells utilized in the original Rowe bill validator in the Model BC-11 bill and coin changer which has now been replaced by the Mars Series 2000 bill validator. The Mars bill acceptor does not include photocell outputs which correspond to the required inputs 100 and 102 to the microprocessor control 50 to condition the microprocessor control 50 to operate properly. Accordingly, the inputs 100 and 102 to the microprocessor control 50 must have a signal disposed thereon which duplicates the signal when the original Rowe bill validator is present and in a standby condition to process bills. The terminal 104 of the conversion board 80 is connected via a current limiting resistor 108 to ground and the terminal 106 is connected via a current limiting resistor 110 to ground. Thus, when the conversion board 80 interconnects the microprocessor control 50 and the Mars bill validator 60, the photocell inputs 100 and 102 of the microprocessor control 50 will be grounded via resistors 108 and 110. The grounding of the inputs 100 and 102 to the microprocessor control 50 conditions the microprocessor control 50 to its normal standby operating condition wherein the bill and coin changer 10 can accept bills in the bill validator 60 and establish an output signal to one of the vend solenoids 62, 64 or 66 when a vend signal is received on one of the test vend inputs 82, 84 or 86. If the inputs 100 and 102 are not grounded via the conversion board 80, the microprocessor control 50 sees a fault and will not energize vend solenoids 62, 64 or 66 when a signal is established on input 82, 84 or 86.

The microprocessor control 50 further includes a 12-volt power output 112 which is connected via board 80 to a 12-volt input 114 of the Mars bill validator and a coin lockout solenoid control output 116 which is connected via board 80 to the Mars bill validator 60. The Mars Series 2000 bill validator 60 includes optocouplers 120, 122 and 124 which must be conditioned with the 12-volt signal from input 114 and with a signal from the coin lockout control 116 to enable the bill validator and condition the microprocessor control 50 to operate one of the vend solenoids 62, 64 and 66 when a signal is directed from the Mars bill validator to one of the test vend inputs 82, 84 or 86 of the microprocessor control 50. Normally, the original function of the coin lockout control is to energize the coin lockout solenoid, which when energized, allows the bill and coin changer 10 to validate currency and dispense change. In the preferred embodiment, the coin lockout solenoid is removed, but the coin lockout output from the microprocessor control 50 is used to condition optocouplers in the new bill validator to a standby condition to accept bills. The coin lockout control 116 includes an output thereon which energizes optocouplers 120, 122 and 124 in the bill validator 60 to condition the bill validator 60 to accept currency. To this end, the optocouplers 120, 122 and 124 are connected via lines 126, 128 and 130 to resistors 132, 134 and 136, respectively, which are connected to the coin lockout output 116 of the microprocessor control 50. A resistor 140 and LED 142 are connected in series. LED 142 is energized and illuminated when the coin lockout control 116 has a ground signal established thereon which conditions the bill validator 60 to accept currency and places the bill and coin changer in a standby condition to accept currency and dispense change. The coin lockout control 116, when energized, enables the bill and coin changer 10 to sense and validate paper currency. The coin lockout control 116 when not enabled, prevents the bill validator 60 from accepting and validating paper currency.

From the foregoing, it should be apparent that a new and improved method of operating a bill and coin changer 10 has been provided. The bill and coin changer 10 includes a new bill validator 60, an existing change dispensing mechanism 11 and an existing microprocessor control 50 for receiving signals from the bill validator and operating the dispensing mechanism 11 in response to the signals. The bill validator is operable to accept and validate paper currency and generate output signals representative of the validity and value of the currency accepted. The microprocessor control 50 includes a plurality of test vend inputs 82, 84 an 86 each of which corresponds to a value of currency to be validated, photocell inputs 100 and 102 for receiving signals indicative of valid currency, and a plurality of coin detector inputs 75, 76 and 78 each of which is operable to receive signals indicative of the receipt of a coin of predetermined value into one of the escrow buckets 24, 26 or 28. The method includes the steps of: (1) sensing currency to be validated with the new bill validator 60; (2) validating the currency and determining its value in the new bill validator 60; (3) establishing an output signal from the bill validator 60 at one of the outputs 88, 90 or 92 indicative of the value and validity of the validated currency; (4) directing the output signal to one of the test vend inputs 82, 84 or 86 of the microprocessor control 50 which corresponds to the value of the validated currency; and (5) operating the change dispensing mechanism 11 under the control of the microprocessor 50, in response to the receipt of a signal to one of the test vend inputs 82, 84 or 86, to cause the change dispensing mechanism 11 to empty one of the escrow buckets 24, 26 or 28 which has coins of a value therein which correspond to the value of the currency which has been sensed and validated in the validator 60. In addition, the method of operating the bill and coin changer further includes the step of conditioning the bills validator 60 and change dispensing mechanism 11 with a signal from the coin lockout solenoid control output to condition the bill validator and change dispensing mechanism to their standby condition in which the bill validator 60 may accept and validate currency and the change dispensing mechanism 11 may dispense coins.

What I claim is:

1. A method of operating a bill and coin changer having a new bill validator installed therein and having an existing change dispensing mechanism having a plurality of escrow buckets and an existing microprocessor control for receiving signals from the bill validator and operating the dispensing mechanism in response to the signals, the bill validator being operable to accept and validate paper currency and generate output signals representative of the validity and value of the currency validated, a microprocessor control including a plurality of test vend inputs each of which corresponds to a value of currency to be validated and each of which, when activated, causes the dispensing mechanism to dispense an amount of change determined by the value of the validated currency, and a plurality of coin detector inputs each of which is operable to receive signals indicative of the receipt of a coin of a predetermined value into an escrow bucket, including the steps of: (a) inserting currency to be validated into the new bill validator; (b) validating the currency and determining its value in the new bill validator; (c) establishing an output signal from the bill validator indicative of the value and validity of the validated currency; (d) directing said output signal to a test vend input of the microprocessor control which corresponds to the value of the validated currency; and (e) operating the change dispenser mechanism under the control of the microprocessor control, in response to the receipt of the signal to the test vend input, to cause the change dispenser mechanism to empty one of the escrow buckets which has coins of a value therein which correspond to the value of the currency which has been validated.

2. A method of operating a bill and coin changer as defined in claim 1, wherein said microprocessor control including a plurality of photocell inputs and further including the step of continuously applying an input to each of the photocell inputs of said microprocessor control which conditions the microprocessor control to its standby condition whereby the bill validator is conditioned to accept currency.

3. A method of operating a bill and coin changer having a bill validator for accepting and validating paper currency, a changer dispensing mechanism for dispensing coins having a value equal to the value dependent upon the validated currency, and a microprocessor control for operating the changer dispensing mechanism in response to the bill validator accepting and validating a unit of paper currency, the bill validator including input means from the microprocessor control for conditioning the bill validator to accept paper currency and an output for establishing a signal indicative of the value of currency validated by the bill validator, the changer dispenser mechanism including a plurality of hoppers each of which is operable to receive coins of a different pre-selected value therein, a plurality of escrow buckets each of which is operable to receive from the hoppers and store coins of a predetermined value, each of the escrow buckets having coins of a different total value which correspond to one of the possible values of currency, to be validated, transport means associated with each of the hoppers for moving coins from the associated hopper to an escrow bucket, motor means associated with each of the transport means for energizing the transport means to move coins from the hopper associated with the transport means to one of the escrow buckets, counter means associated with each of the hoppers for counting the coins passing from the hopper to one of the escrow buckets, the microprocessor control includes a plurality of test vend inputs each of which correspond to a possible value of currency to be validated, photocell inputs, a plurality of coin detector inputs each of which is operable to receive signals from said counter means indicative of the receipt of a coin of a predetermined value from a hopper into an escrow bucket, said method of operating the bill and coin changer, including the steps of: (1) inserting currency to be validated into the bill validator; (2) validating the currency in the bill acceptor and validator; (3) establishing an output signal from the bill validator indicative of the validity and value of validated currency; (4) directing said output signal to the test vend input of the microprocessor which corresponds to the value of the validated currency; and (5) operating the changer dispenser mechanism in response to the receipt of the signal to the test vend input of the microprocessor to cause the changer dispenser mechanism to dispense coins from the escrow bucket which has coins stored therein which have a value which is related to the value of the validated currency.

4. A method of operating a bill and coin changer as set forth in claim 3 further including the steps of continuously applying an input to each of the photocell inputs of said microprocessor control which conditions the microprocessor control to its standby condition whereby the bill validator is conditioned to validate currency.

5. A method of operating a bill and coin changer having a new bill validator installed therein and having an existing change dispensing mechanism having a plurality of escrow buckets and an existing microprocessor control for receiving signals from the bill validator and operating the dispensing mechanism in response to the signals, the bill validator being operable to accept and validate paper currency and generate output signals representative of the validity and value of the currency validated, a microprocessor control including a plurality of test vend inputs each of which corresponds to a value of currency to be validated and each of which, when activated, causes the dispensing mechanism to dispense an amount of change determined by the value of the validated currency, and a plurality of coin detector inputs each of which is operable to receive signals indicative of the receipt of a coin of a predetermined value into an escrow bucket, including the steps of: (a) inserting currency to be validated into the new bill validator; (b) validating the currency and determining its value in the new bill validator; (c) establishing an output signal from the bill validator indicative of the value and validity of the validated currency; (d) directing said output signal to a test vend input of the microprocessor control which corresponds to the value of the validated currency; and (e) operating the change dispenser mechanism under the control of the microprocessor control, in response to the receipt of the signal to the test vend input, to cause the change dispenser mechanism to empty one of the escrow buckets which has coins of a value therein which correspond to the value of the currency which has been validated, wherein the microprocessor control further includes a coin lockout solenoid control output and further including the step of directing the output signal from the coin lockout solenoid control output to the bill validator to condition the bill validator to its standby condition in which the bill validator is in condition to receive and validate currency.

6. A method of operating a bill and coin changer having a new bill validator installed therein and having an existing change dispensing mechanism having a plurality of escrow buckets and an existing microprocessor control for receiving signals from the bill validator and operating the dispensing mechanism in response to the signals, the bill validator being operable to accept and validate paper currency and generate output signals representative of the validity and value of the currency validated, a microprocessor control including a plurality of test vend inputs each of which corresponds to a value of currency to be validated and each of which, when activated, causes the dispensing mechanism to dispense an amount of change determined by the value of the validated currency, and a plurality of coin detector inputs each of which is operable to receive signals indicative of the receipt of a coin of a predetermined value into an escrow bucket, including the steps of: (a) inserting currency to be validated into the new bill validator; (b) validating the currency and determining its value in the new bill validator; (c) establishing an output signal from the bill validator indicative of the value and validity of the validated currency; (d) directing said output signal to a test vend input of the microprocessor control which corresponds to the value of the validated currency; and (e) operating the change dispenser mechanism under the control of the microprocessor control, in response to the receipt of the signal to the test vend input, to cause the change dispenser mechanism to empty one of the escrow buckets which has coins of a value therein which correspond to the value of the currency which has been validated, wherein said microprocessor control further includes a plurality of photocell inputs and a coin lockout solenoid control output and further including the steps of continuously applying an input to each of the photocell inputs of said microprocessor control which conditions the microprocessor control to its standby condition whereby the bill validator is conditioned to accept currency and directing the output signal from the coin lockout solenoid control output to the input of the bill validator to condition the bill validator to its standby condition in which the bill validator is in condition to receive and validate currency.

7. A method of operating a bill and coin changer having a bill validator for accepting and validating paper currency, a changer dispensing mechanism for dispensing coins having a value equal to the value dependent upon the validated currency, and a microprocessor control for operating the changer dispensing mechanism in response to the bill validator accepting and validating a unit of paper currency, the bill validator including input means from the microprocessor control for conditioning the bill validator to accept paper currency and an output for establishing a signal indicative of the value of currency validated by the bill validator, the changer dispenser mechanism including a plurality of hoppers each of which is operable to receive coins of a different pre-selected value therein, a plurality of escrow buckets each of which is operable to receive from the hoppers and store coins of a predetermined value, each of the escrow buckets having coins of a different total value which correspond to one of the possible values of currency to be validated, transport means associated with each of the hoppers for moving coins from the associated hopper to an escrow bucket, motor means associated with each of the transport means for energizing the transport means to move coins from the hopper associated with the transport means to one of the escrow buckets, counter means associated with each of the hoppers for counting the coins passing from the hopper to one of the escrow buckets, the microprocessor control includes a plurality of test vend inputs each of which correspond to a possible value of currency to be validated, photocell inputs, a plurality of coin detector inputs each of which is operable to receive signals from said counter means indicative of the receipt of a coin of a predetermined value from a hopper into an escrow bucket, said method of operating the bill and coin changer, including the steps of: (1) inserting currency to be validated into the bill validator; (2) validating the currency in the bill validator; (3) establishing an output signal from the bill validator indicative of the validity and value of validated currency; (4) directing said output signal to the test vend input of the microprocessor which corresponds to the value of the validated currency; and (5) operating the changer dispenser mechanism in response to the receipt of the signal to the test vend input of the microprocessor to cause the changer dispenser mechanism to dispense coins from the escrow bucket which has coins stored therein which have a value of the validated currency and wherein the microprocessor control includes a coin lockout solenoid control output and further including the step of directing the output signal from the coin lockout solenoid control output to the input of the bill validator to condition the bill validator to its standby condition in which the bill validator is in condition to receive and validate currency.

8. A method of operating a bill and coin changer having a bill validator for accepting and validating paper currency, a changer dispensing mechanism for dispensing coins having a value equal to the value dependent upon the validated currency, and a microprocessor control for operating the changer dispensing mechanism in response to the bill validator accepting and validating a unit of paper currency, the bill validator including input means from the microprocessor control for conditioning the bill validator to accept paper currency and an output for establishing a signal indicative of the value of currency validated by the bill validator, the changer dispenser mechanism including a plurality of hoppers each of which is operable to receive coins of a different pre-selected value therein, a plurality of escrow buckets each of which is operable to receive from the hoppers and store coins of a predetermined value, each of the escrow buckets having coins of a different total value which correspond to one of the possible values of currency to be validated, transport means associated with each of the hoppers for moving coins from the associated hopper to an escrow bucket, motor means associated with each of the transport means for energizing the transport means to move coins from the hopper associated with the transport means to one of the escrow buckets, counter means associated with each of the hoppers for counting the coins passing from the hopper to one of the escrow buckets, the microprocessor control includes a plurality of test vend inputs each of which correspond to a possible value of currency to be validated, photocell inputs, a plurality of coin detector inputs each of which is operable to receive signals from said counter means indicative of the receipt of a coin of a predetermined value from a hopper into an escrow bucket, said method of operating the bill and coin changer, including the steps of: (1) inserting currency to be validated into the bill validator; (2) validating the currency in the bill validator; (3) establishing an output signal from the bill validator indicative of the validity and value of validated currency; (4) directing said output signal to the test vend input of the microprocessor which corresponds to the value of the validated currency; and (5) operating the changer dispenser mechanism in response to the receipt of the signal to the test vend input of the microprocessor to cause the changer dispenser mechanism to dispense coins from the escrow bucket which has coins stored therein which have a value of the validated currency and wherein the microprocessor control further includes a coin lockout solenoid control and further including the steps of continuously applying an input to each of the photocell inputs of said microprocessor control which conditions the microprocessor control to its standby condition whereby the bill validator is conditioned to validate currency and directing the output signal from the coin lockout solenoid control output to the input of the bill validator to condition the bill validator to its standby condition in which the bill validator is in its standby condition to receive and validate currency.

* * * * *